United States Patent [19]

Fuller

[11] Patent Number: 4,462,867

[45] Date of Patent: Jul. 31, 1984

[54] PAPER INCORPORATING A PARTIALLY EMBEDDED STRIP

[75] Inventor: James S. Fuller, Platford, England

[73] Assignee: Portals Limited, Hampshire, England

[21] Appl. No.: 397,158

[22] Filed: Jul. 12, 1982

[30] Foreign Application Priority Data

Jul. 13, 1981 [GB] United Kingdom ..... 8121564
Dec. 9, 1981 [GB] United Kingdom ..... 8137104
Mar. 22, 1982 [GB] United Kingdom ..... 8208348

[51] Int. Cl.[3] ..... D21D 3/00

[52] U.S. Cl. ..... 162/103; 162/109; 162/140

[58] Field of Search ..... 162/103, 105, 110, 108, 162/116, 140, 109; 428/915, 916

[56] References Cited

U.S. PATENT DOCUMENTS 3,880,706 4/1975 Williams ..... 162/140

FOREIGN PATENT DOCUMENTS 19963 6/1910 United Kingdom .
237828 8/1925 United Kingdom ..... 162/140
423281 1/1935 United Kingdom .
606862 8/1948 United Kingdom .
1008703 11/1965 United Kingdom .
1074118 6/1967 United Kingdom .
1127043 9/1968 United Kingdom .
1354414 5/1974 United Kingdom .
1365876 9/1974 United Kingdom ..... 162/140
1415538 11/1975 United Kingdom .
1447933 9/1976 United Kingdom .
1474348 5/1977 United Kingdom .
1498037 1/1978 United Kingdom .
1552853 9/1979 United Kingdom .

*Primary Examiner*—Peter Chin
*Attorney, Agent, or Firm*—Buell, Blenko, Ziesenheim & Beck

[57] ABSTRACT

A method of forming a paper comprises depositing paper fibres onto a support surface from a furnish by drainage, laying a strip having fibre deposition blocking regions and fibre deposition permitting regions onto the deposited fibres and continuing deposition to form a paper having the strip partially embedded in the paper and partially exposed.

9 Claims, 10 Drawing Figures

PAPER INCORPORATING A PARTIALLY EMBEDDED STRIP

FIELD OF THE INVENTION

The present invention relates to paper, such as security paper, containing a strip in part embedded in the paper, to security documents made from such paper and to methods of making such paper.

BACKGROUND OF THE INVENTION

In our British patent specification No. 1365876, we described a security paper having a porous tape incorporated therein as a security device. The provision of a security device in the form of a tape or strip is conventional. The tape or strip is normally incorporated in the paper as the paper is made on a cylinder mould papermaking machine. In such a machine paper is deposited on a mesh which rotates in a paper furnish whilst liquid flows from the furnish into the mesh. The tape or strip usually incorporated into paper as a security device is normally very narrow, e.g. 0.5 mm in width. This narrow width is necessary because the tape or strip is of impermeable material, e.g. polyester plastics film and therefore blocks the flow of liquid through the mesh at the point where it lies. If the tape or strip is too wide, paper fibres cannot bridge the tape or strip and the tape is therefore exposed on one side of the paper instead of being incorporated into the thickness of the paper. The tape or strip disclosed in our specification No. 1365876 was porous and therefore could be incorporated into paper on a cylinder mould-making machine even when of substantial width, e.g. 1½" wide since it did not block the flow of liquid from the furnish through the wire mesh of the cylinder mould machine.

SUMMARY OF THE INVENTION

It has now been found that by providing regions offering a differing obstacle to fibre deposition, e.g. regions of permeability and regions of impermeability, along a strip or tape, it may be incorporated in a paper on a cylinder mould-making machine so that some regions, e.g. the permeable regions are embedded in the thickness of the paper and others, e.g. the less permeable regions, are exposed on one surface of the paper. The invention provides a method of forming a paper as described above which comprises depositing paper fibres onto a support surface from a suspension by drainage of the suspension fluid through the support surface, laying a strip over the deposited paper fibres which strip has first regions which will obstruct further drainage sufficiently to prevent any substantial deposition of paper fibres thereover and second regions which obstruct further drainage insufficiently to prevent further deposition of paper fibres thereover, and depositing further paper fibres by drainage through the support surface so as to form a paper having the strip in part embedded therein and in part exposed on one surface thereof.

The present invention also provides a paper containing a strip having first regions exposed at one surface of the paper and second regions embedded in the thickness of the paper produced by such a method.

By the term "exposed" as used herein is meant that the strip is substantially more visible at "exposed areas" than where disposed in the thickness of the sheet. This may be by virtue of being overlaid by little or none of the fibre material making up the sheet. Alternatively, it may be by virtue of being overlaid by a substantially lower weight per unit area of fibres than in unexposed areas, which overlying fibres are rendered transparent by appropriate treatment in the "exposed" areas. It is also permitted that the sheet include a transparent or translucent overlay which covers the "exposed" areas of the strip.

Preferably the paper is a security paper and preferably the regions of the paper where the strip is exposed are regions in which a watermark is formed. Preferably this watermark is a cylinder mould watermark but it would be possible to form a dandy roll watermark instead or additionally.

The strip may be from 0.5 mm wide to the full width of the sheet in which it is to be incorporated. Preferably, however, the width will be between 1 and 30 mms. The width of the sheet is preferably from 500 to 5000 mm.

When incorporated into paper, the strip will preferably not increase the thickness or weight per unit area of the finished plain paper by more than 100%.

The second regions of the strip may obstruct drainage insufficiently to prevent themselves being covered by paper fibres by virtue of their being permeable to the suspending medium of the furnish or they may be too small, e.g. too thin, to pose such an obstruction. Where they are permeable, the strip may be considered to be made up of permeable and impermeable regions.

The permeable regions of such strips are permeable so as not to provide such a barrier to water flow in the paper making process as to prevent a sufficient rate of paper fibre deposition thereover. The rate of deposition must be great enough to ensure that these portions become incorporated in the body of the paper.

The permeable regions therefore should preferably allow substantially free flow of water therethrough. Accordingly, the invention also provides paper containing a strip partially embedded in the paper and characterised in that the strip has permeable regions embedded in the thickness of the paper and relatively impermeable regions exposed at one surface of the paper.

The strip may be made from generally impermeable materials in which selected regions have been made permeable.

For example, the strips may be made from:

(a) Close-structured or coated papers.

(b) Films extruded from thermoplastics materials such as polyethylene or polypropylene.

(c) Films formed by casting from materials such as regenerated cellulose or polyvinylalcohol.

(d) Closely woven textiles made from natural or synthetic materials.

(e) Dense non-woven fabrics produced by dry or wet-lay processes from, for example, rayon or polyethylene teraphthalate fibres.

(f) Any suitable permeable material which has been made generally impermeable by the application of a coating, film or other suitable treatment such as fusion.

Selected regions may be made permeable by any convenient method such as will readily occur to those skilled in the art, for example, by selective perforation, by repetitive slitting or bursting or by repetitive removal of small areas of material by cutting or melting, or by combinations thereof.

Alternatively, the strips may be made from generally permeable materials in which selected regions have been impermeable. For example, the strips may be made from:

(g) fabrics consisting of one or more thin individual elements so constructed as to form an open mesh structure, for example, by weaving, knitting, glueing or spin bonding.

(h) Open-structured tissues or papers.

(i) Thin non-woven fabrics produced by dry or wet-lay processes from, for example, rayon or polyethylene teraphthalate fibres.

(j) Plastics netting, for example, a netting of a thermoplastics material such as polyamide, polyethylene or polypropylene.

Selected regions may be made impermeable by any convenient method such as will readily occur to those skilled in the art, for example, by fusing selected areas of the material together to form a continuous film or by coating selected areas with impermeable materials.

Strips which incorporate regions of permeability and impermeability may also be made by bonding together materials of different permeabilities to provide the requisite drainage pattern in the composite strips.

The strip materials of the invention in which selected areas are permeable and other are impermeable will preferably incorporate characteristics which are selected to act as security features in the finished sheet. These may be intended to be sensed visually, tactilely and/or by appropriate instrumentation. Of course, a security feature should ideally be chosen so as to be easy to incorporate during manufacture of a genuine product yet difficult to provide in imitation sheets.

For example, in permeable regions of strips made from netlike materials, nodules or knuckles may be incorporated to cause variations in contours of the finished sheet whose tactile effect may readily be detected by hand or by instrument.

Similarly, such materials may form a characteristic pattern readily detectable by transmitted, but not reflected, light. This optical effect may be enhanced by any convenient means; for example, by vacuum metallisation of the permeable regions of the strip prior to incorporation into the sheet. The presence of such metallisation may also be detected by appropriate means by virtue of its substantially greater electrical conductivity or density than that of the sheet.

The permeable regions of the strip may form a characteristic mesh pattern readily recognisable in transmitted light but not in reflected light. The pattern may be cut into the strip by, for example, a laser beam to produce pattern difficult to imitate by other means.

Again, permeable regions of strips provided by the invention may incorporate or be coated with magnetic materials whose field pattern after magnetisation can be detected by appropriate instruments and which may correspond with the structure or surface discontinuities of the strip itself. Alternatively, metallic or magnetic materials may be selected to provide predetermined hysteresis, eddy current, remanent flux or coercivity phenomena detectable by instruments external to the sheet.

Permeable regions of strips may, nevertheless, provide sufficient surface continuity to receive coatings of materials which respond to various forms of excitation. For example, materials which fluoresce or phophoresce when irradiated with ultra-violet light. Such coatings may be discontinuous and may, for example, be printed or otherwise applied to form a pattern or series of numbers and/or letters to form a progression along the length of the strip.

The invention includes papers containing strips with permeable regions incorporating characteristics as described hereinabove. It is to be particularly noted, however, that the invention also includes papers containing strips wherein any of the above characteristics may additionally, or alternatively, be incorporated into impermeable regions of the strip.

The invention also provides papers containing strips incorporating characteristics which may be more easily sensed or detected when they coincide with exposed regions of the strip. These characteristics are therefore preferably included in the impermeable regions of the strip but may, of course, extend into the permeable regions. Characteristics of this kind include those provided by thin film dichroic filters, by diffraction gratings, by magnetic materials, by electrically conductive or phosphorescent materials or materials incorporating hologram or providing holographic effects or a combination of two or more of the above.

Preferably the permeable regions of the strip have a grammage of from 5 to 50 gms per square meter.

Preferably the grammage of the impermeable regions of the strip is about 25 gms/m$^2$ although grammages of as low as 10 and as high as 100 gms/m$^2$ may be used.

Some materials which may be used for the strip are such as will be permanently compressed by normal papermaking machinery. The paper itself is normally considerably compressed after the first stage of its manufacture. In general therefore strip materials which are bulky but easily permanently compressed under pressures of the order of 10,000 lbs. per square inch i.e. 68,950 kilonewtons per square meter or whose materials are such that permanent compression occurs under pressures substantially less than 10,000 lbs per square inch provided that the web is first saturated with water or, alternatively, heated to temperatures up to 150° C. or both may have substantially greater initial thicknesses. For example, a permeable web made from thermoplastic filaments and having an initial thickness of 350 microns (measured at 20° C., 65% relative humidity under a uniform pressure of 7.3 lbs/in$^2$ i.e., 50 kilonewtons per square meter) was subsequently found to be satisfactory.

Permeable regions of strips which do not easily permanently compress as defined above will preferably be between 12 and 75 microns in thickness.

Permeable regions of strips which easily permanently compress as defined above will preferably be between 75 and 350 microns on thickness.

A strip for use in the invention may include a magnetic, fluorescent, phosphorescent, metallic, electrically conductive or dichroic filter material or a diffraction grating or a combination of two or more of these features.

The strip may have permeable parts made from a plastics or metal film, a textile material, a non-woven fabric, a paper or a plastics material.

Where the permeable material is in the form of a narrow ribbon (i.e. 1.0 to 30 mms. wide), the impermeable regions will preferably be narrower than the ribbon width, where possible by at least 2 mms., but preferably not less than 0.75 mm. wide.

The strip may be formed by attaching pieces of impermeable material as spaced locations along a permeable base strip. For instance discs or other shapes of plastics or metallic film or foil may be attached by adhesive to a permeable web.

More preferably however, the strip may be composed of a permeable base strip bearing an impermeable strip having a series of spaced regions sufficiently large to interfere with fibre deposition linked by narrow bridge portions to form a continuous strip. The narrow bridge portions are sufficiently narrow not to interfere with fibre deposition and so become buried during the papermaking process. The spaced "islands" constituted by the larger regions of the impermeable strip are left revealed.

Impermeable strips of the kind may be incorporated into paper without being supported on a permeable carrier and such methods of incorporation and papers thereby produced form part of this invention.

The invention includes a security document such as a banknote made from a paper of the invention.

DESCRIPTION OF PREFERRED EMBODIMENTS

The invention will be illustrated by the following description of a preferred embodiment with reference being made to the accompanying drawing in which.

Figure 4A:
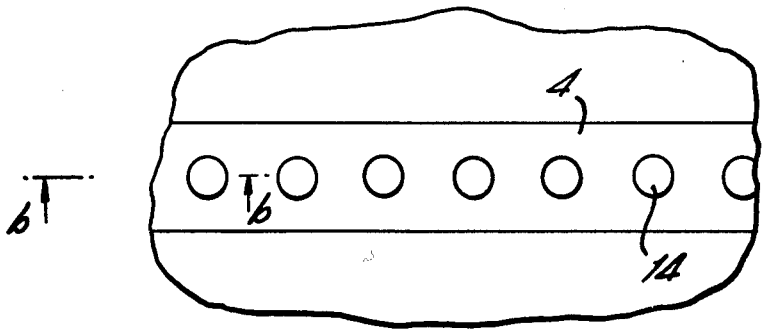

FIG. 4*a* shows a plan view of a suitable strip incorporated into paper.

Figure 4B:
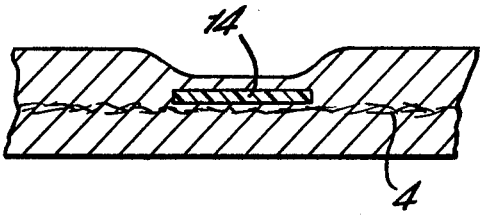

FIG. 4*b* shows a section through the paper of FIG. 4*a* on the line b—b.

Figure 5:
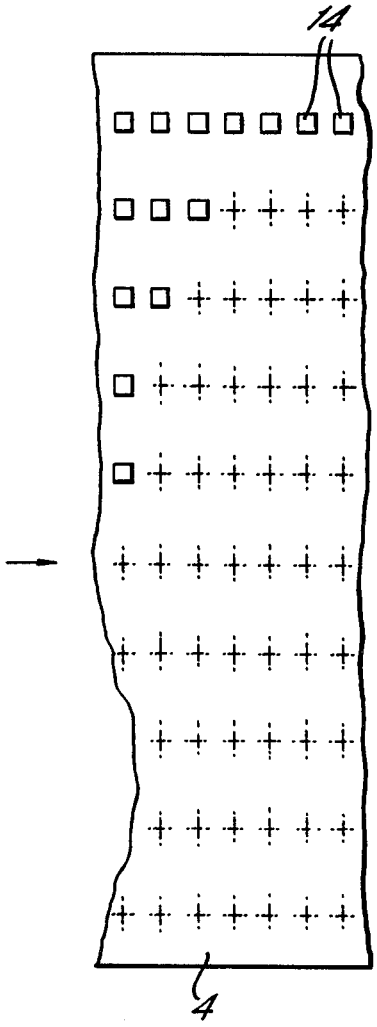

FIG. 5 shows a plan view of a further strip suitable for use in the invention.

Figure 6:
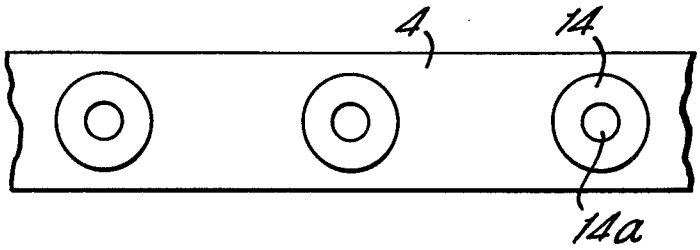

FIG. 6 shows a plan view of another strip suitable for use in the invention.

Figure 9:
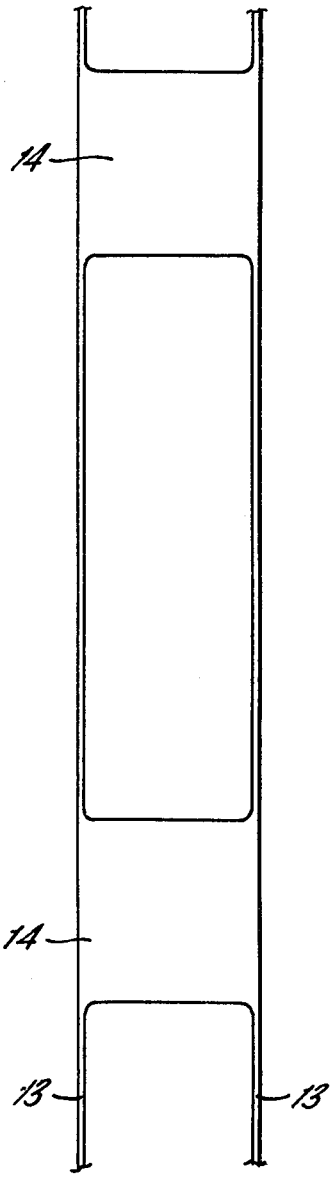
Figure 7:
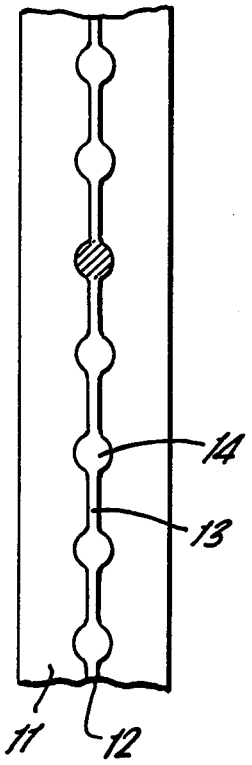
Figure 8:
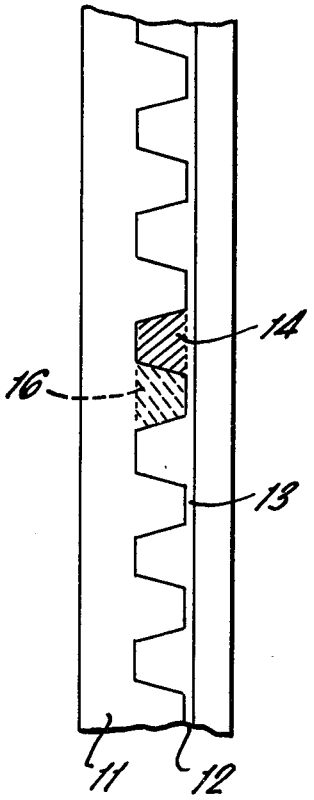

FIGS. 7, 8 and 9 each show yet other strip suitable for use in the invention, in each case in plan view.

Figure 1:
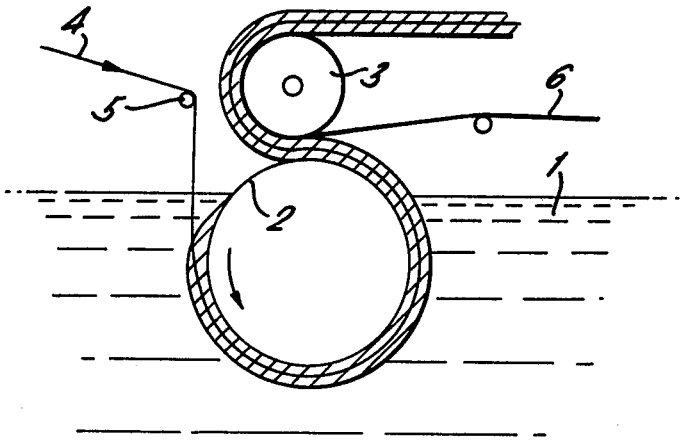
FIG. 1 shows a cylinder mould papermaking machine in the process of making a paper according to the invention.

As seen in FIG. 1, a cylinder mould papermaking machine comprises a bath containing a paper furnish 1 wherein a papermaking mould in the form of a cylinder having a wire mesh surface 2 rotates whilst suction is applied to the interior of the cylinder. Fluid is drained through the wire mesh causing paper fibres to deposit upon the cylinder as it rotates. Finished paper is removed from the surface 2 by couch roll 3 and is transferred to belt 6 for subsequent treatment such as drying.

A strip 4 having a series of permeable regions and impermeable regions spaced along its length is fed over a guide 5 into the bath of paper furnish so as to contact the mould after a certain thickness of paper fibres has been deposited thereon. As the mould rotates past the point at which the strip contacts the initial deposit of paper fibres, further fibres are deposited over the strip at those regions where the strip is permeable. The impermeable regions of the strip however serve to block the deposit of fibres thereover so that the strip lies exposed on one surface of the paper where it is impermeable.

By arranging for the impermeable region of the strip to come to lie over areas of the cylinder mould wire mesh carrying the impression of a desired watermark, the finished paper can be made so that the exposed portions of the strip 4 lie over a watermark on the paper.

Alternatively or additionally, the feeding of the strip and the rotation of the mould may be synchronised so that the impermeable areas of the strip come to lie over areas of the mould wire mesh surface alongside which are areas of the mesh surface which lie below the general level of the mesh surface. The effect of this on the paper produced is that in register with the exposed areas of the strip will be flanking areas of paper which are somewhat thickened, thus providing some reinforcement of the paper and reducing feathering of fibres over the impermeable feature.

Figure 2:
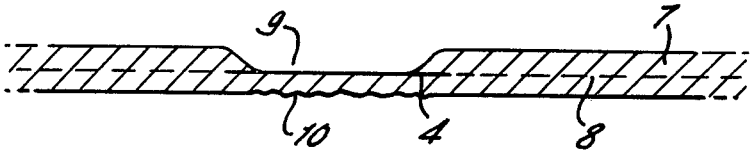
FIG. 2 shows a cross-section through a paper according to the invention.

FIG. 2 shows a cross-section through a paper according to the invention in which a strip 4 is generally embedded within the thickness of a paper 7. The strip 4 has interstices 8 rendering it permeable except in the region 9 where the strip is impermeable. In the region 9, the strip is exposed on one side of the paper and on the other side of the paper, is covered by paper fibres. As indicated by numeral 10, the paper adjacent the exposed impermeable portion of the strip 4 bears a watermark and has an irregular thickness.

Figure 3:
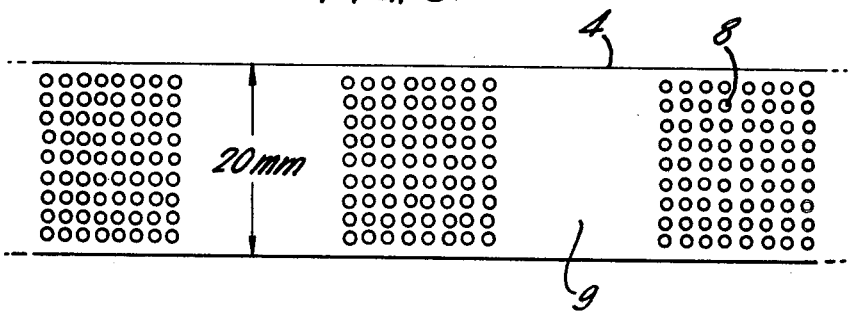
FIG. 3 shows a plan view of a suitable strip for use in forming a paper according to the invention.

FIG. 3 shows a suitable strip 4 incorporated into paper according to the invention. The strip shown is a strip of plastics film approximately 20 mm wide and approximately 13 microns thick. The film is divided into regions containing numerous perforations 8, such as pinholes, rendering the strip permeable and regions 9 which are not perforated.

FIG. 4*a* is a plan view of a strip 4 incorporated into paper in accordance with the invention. The strip was made from continuous filaments of polyamide material spun-bonded to form a water-permeable, fabric-like sheet. The strip shown was slit from a continuous web of the above material and is 15 mms. wide. Before insertion into the paper, the strip was 140 microns thick and had a density of 25 gms. per square meter.

At regular intervals of 15 mms. along the length of the strip, discs 14 each of 5 mms. in diameter (cut from a sheet of impermeable polyester film carrying multiple depositions to form a thin film dichroic filter) were bonded to the strip prior to insertion in the paper.

The paper was made from stock which included some long fibres (5 to 10 mms. long) and the strip was run into the machine so as to lie in the centre of the section of the paper.

It was found that the longer fibres in the stock formed a matrix which bridged over each disc but, because the discs were impermeable and prevented direct drainage, the layer of fibres in the matrix was extremely light i.e., no more than a few grammes per square meter, compared with the paper sheet which weighed 80 gms. per square meter.

After pressing and drying the paper, a continuous coating from a paraffin wax emulsion was applied to the paper over the position occupied by the strip.

It was found that the strip was barely visible within the paper but, because of the low weight of fibre over each disc and the transparentising effect of the wax applied thereto, the variation in colour and reflectively of the discs when viewed, first, in reflected and then in transmitted light could be clearly discerned.

Closer examination revealed a variation in thickness of fibres overlying each disc making it evident that the discs had been incorporated into the body of the paper and had not merely been applied thereto after manufacture as shown in the enlarged sectional view on one of the discs in FIG. 4*b*.

The paper was later printed and cut into security documents each 60 mms. wide so that each document contained four visible discs within its width.

FIG. 5 is a plan view on another strip prior to incorporation into a sheet of paper in accordance with the present invention.

In this case, the "strip" 4 has been prepared for incorporation into a web of paper 1.6 meters wide intended for eventual sub-division into individual security documents each 150 mms. wide. Thus, during sub-division, ten documents will be cut from the width of the web, the remainder of the sheet being waste.

The strip is also approximately 1.6 meters wide and contains, within its width, ten rectangular, impervious regions 14 to provide ten areas of exposure in the sheet i.e., one exposure per document. The lines of impervious regions are repeated at regular intervals of 65 mms. along the length of the strip so that, when the strip is stretched as it is incorporated into the paper, the interval between lines of impervious regions will increase to 68 mms. to correspond with the eventual document height.

A strip of the dimensions shown in FIG. 5 was manufactured from high density polyethylene melt extruded to form a permeable mesh. The rectangular impermeable regions 14 shown in FIG. 5 were cut from 12 micron thick polyester film coated with magnetic oxide each rectangle then being bonded to the mesh to form the pattern indicated in FIG. 5. Each rectangle was 15 mms. long by 10 mms. wide.

The entire strip was run into a papermaking machine so that in the permeable areas 60 gsm of fibres lay below the strip and 20 gsm of fibres lay above it. The paper was then pressed, dried, printed and cut into documents so that each document incorporated one rectangle of impermeable material.

It was found that the heat used to dry the paper had melted the polythene mesh causing it to adhere strongly to the surrounding paper fibres.

In those regions occupied by the impermeable rectangles, no fibre deposition had occurred over the rectangles except at their peripheries and, as a result, each printed document contained a rectangular area of about 12 mms. by 7 mms. in which the magnetic coating was completely exposed.

It was found that, when the documents were first placed in a magnetic field and then moved past a device sensitive to magnetic flux, the presence of the magnetic material could be more readily detected than would have been the case had the rectangles been overlaid with fibres.

A web of dry laid and bonded viscose fibres was slit into continuous strips (4) 22 mms. wide. At regular intervals, discs 14 of paper each having a central aperture 14*a* were bonded along the length of the strips with a polyvinylalcohol adhesive as shown in plan view in FIG. 6.

Each paper disc 14 was 15 mms. in diameter and contained a central hole 5 mms. in diameter. The discs were printed in multiple colours and coated with silicone.

The strip was run into a papermaking machine so that the strip lay in the centre of the section of the paper.

It was found that the annular area of impermeability provided by each disc had prevented fibre deposition thereon and fibres which had temporarily adhered were easily washed off the silicone coated discs as the paper left the forming zone of the machine. The discs were therefore strongly bonded to the paper at their edges and at the central hole but the striking printed colours on the surface of each disc were directly exposed to view.

FIGS. 7, 8 and 9 illustrate three strips for use in the invention made by laminating two continuous strips, one permeable and one impermeable together. In each case, a permeable base strip 1 bears a ribbon 12 of impermeable material such as plastics film or metal foil bonded thereto. For instance the strip may be of 12 micrometer polyester film metallised on one side.

Ribbon 12 is cut to have a varying with and has narrow bridges 13 linking wider "islands" 14. The bridges are narrow, generally less than 3 mm, preferably less than 0.75 mm and preferably about 0.5 mm so that in the papermaking process they are bridged by depositing fibres and are buried. The "islands" are too large to be bridged, e.g. have an area of more than about 3 mm square or 3 mm diameter.

The ribbon shown in FIG. 8 is so shaped that a plurality of identical ribbons can be cut from a sheet without waste. The area 16 cut from ribbon 12 serves as an "island" in a second ribbon.

The embodiment shown in FIG. 9, the space between the "islands" 14 is 50 mm long and the "islands" themselves are 16 mm long. The "islands" have been formed in a plastics film strip by cutting by laser or by water jet to leave two connecting bridges at each end of each "island".

Impermeable strips 14 of the kind shown in FIG. 9 are particularly suitable for incorporation in paper without a permeable carrier. The visual effect produced is of course essentially the same whether a permeable carrier is present or not. The carrier naturally greatly increases the robustness of the strip.

Strips provided and incorporated into sheets in accordance with the invention will, preferably, be bonded with the fibres of the finished sheet. Appropriate methods of strip-to-sheet bonding include heat treatment to cause thermoplastic materials provided in or on the strip (or sheet) to melt and fuse with similar thermoplastic materials provided within the sheet (or strip). Alternatively, water soluble bonding materials may be incorporated into the strip and/or with the fibres forming the sheet such that, when wetted, for example, during the sheet formation process, dissolution and migration of the bonding materials occurs and, on drying, strong bonds are formed between strip and sheet.

Or, again, bonds may be developed in the finished product, for example, by coating, impregnating or saturating the finished strip/sheet assembly with suitable materials such as polyvinylalcohol, latex, or polyamide in aqueous or solvent solutions or suspensions. Other methods of developing bonds in the completed strip/-sheet assembly will readily occur to those skilled in the art. For example, where the strip and/or sheet contain materials with low melting points, spot welding techniques may usefully be applied.

The first regions of the strip will block any substantial deposition of paper fibres from the furnish subsequent to the point of insertion of the strip into the papermaking machine. However, some fibres may well stray on to these areas, particularly around the edges thereof. It may be desirable to remove such straying fibres whilst the paper is still fresh and wet by such methods as directing a jet of water onto the freshly made paper to remove loose fibres. Such a jet may be arranged to operate only on those areas of the paper where the strip is or, is extended to be, exposed. Alternatively, the freshly made paper may be run underneath a flexible tongue which contacts the paper with a force determined by a weight or other suitable means such as a spring. Water may be sprayed on the paper just before it runs under the tongue to mobilise the paper fibres which it is intended to sweep from the exposed surface of the strip. Other methods for preventing or discouraging the deposition of fibres over these regions of the strip may be employed.

These include raising the surface of the first regions relative to the surrounding permeable regions. This may be achieved by any convenient means such as by embossing the impermeable regions or, in the case of a composite strip, by making the overall thickness of the first regions greater than the surrounding regions.

Other methods of discouraging fibre deposition and retention over these regions of the strip include, for example, the application of non-wetting agents such as silicone or polytetrafluoroethylene to the first regions of the strip. Similarly, the application of smooth, low friction sealing materials such as waxes and cast films have been found to be efficacious in some circumstances.

Where a sheet includes a transparent overlay to protect the exposed areas of the strip, the overlay may for instance be a sheet of plastics film attached to the sheet e.g. by adhesives. Alternatively, the overlay may be applied as liquid, for instance a solution of polymer or of film forming latexes. Alternatively, the protective overlay may be formed by formation of a polymer layer in situ from polymer precursors. An example of this would be the use of a polyurethane varnish.

I claim:

1. A method of forming a paper for security documents which method comprises depositing paper fibres from a liquid suspension onto a support surface from a furnish by drainage through the support surface, laying a strip over the deposited paper fibres, which strip has first regions of predetermined shape which will obstruct further drainage sufficiently to prevent any substantial deposition of paper fibres thereover and second regions which will obstruct further drainage insufficiently to prevent further deposition of paper fibres thereover, and depositing further paper fibres by drainage through said second regions and support surface so as to form a paper having the strip in part embedded therein and in part exposed on one surface thereof, the embedded part corresponding with said second regions and the exposed part corresponding with said first regions.

2. A method as claimed in claim 1 wherein the strip comprises permeable regions constituting the said second regions and relatively impermeable regions constituting the said first regions.

3. A method as claimed in claim 2 wherein the permeable regions of the strip have a grammage of from 5 to 50 gms per square meter.

4. A method as claimed in claim 2 wherein the grammage of the impermeable regions of the strip is from 10 to 100 gms/$m^2$.

5. A method as claimed in claim 2 wherein the permeable regions of the strip when subjected to the moisture, heat and pressure conditions experienced by paper in the papermaking process do not suffer any substantial permanent compression and have thicknesses before insertion into the paper of between 12 and 75 microns.

6. A method as claimed in claim 2 wherein the permeable regions of the strip when subjected to the moisture, heat and pressure conditions experienced by paper in the papermaking process suffer substantial permanent compression and have thicknesses before insertion into the paper of between 75 and 300 microns.

7. A method as claimed in claim 1 wherein the regions of the paper where the strip is exposed are regions in which a watermark is formed.

8. A method as claimed in claim 1 wherein the strip includes a security feature selected from the group consisting of magnetic, fluorescent, phosphorescent, metallic, and electrically conductive materials, dichroic filter materials, diffraction gratings, and holograms.

9. A method as claimed in claim 1 wherein the strip is made from a material selected from the group consisting of plastics film, metal film, textile material, non-woven fabric, paper and a plastics netting material.

* * * * *